US007314119B2

(12) United States Patent
Husmann et al.

(10) Patent No.: US 7,314,119 B2
(45) Date of Patent: Jan. 1, 2008

(54) EQUIPMENT FOR VIBRATION DAMPING OF A LIFT CAGE

(75) Inventors: Josef Husmann, Lucerne (CH); Elena Cortona, Thalwil (CH)

(73) Assignee: Inventio AG, Hergiswil (CH)

( * ) Notice: Subject to any disclaimer, the term of this patent is extended or adjusted under 35 U.S.C. 154(b) by 546 days.

(21) Appl. No.: 11/018,906

(22) Filed: Dec. 21, 2004

(65) Prior Publication Data

US 2005/0139430 A1 Jun. 30, 2005

(30) Foreign Application Priority Data

Dec. 22, 2003 (EP) ..... 03405918

(51) Int. Cl.
*B66B 1/34* (2006.01)

(52) U.S. Cl. ..... 187/292; 187/409

(58) Field of Classification Search ..... 187/292, 187/391–394, 409, 410
See application file for complete search history.

(56) References Cited

U.S. PATENT DOCUMENTS

| | | | | |
|---|---|---|---|---|
| 5,304,751 | A | 4/1994 | Skalski et al. | |
| 5,652,414 | A * | 7/1997 | Roberts et al. | 187/292 |
| 5,864,102 | A * | 1/1999 | Jamieson et al. | 187/292 |
| 5,866,861 | A * | 2/1999 | Rajamani et al. | 187/292 |
| 5,896,949 | A | 4/1999 | Hamdy et al. | |
| 5,929,399 | A * | 7/1999 | Jamieson et al. | 187/391 |
| 6,338,396 | B1 * | 1/2002 | Morishita | 187/292 |
| 6,401,872 | B1 * | 6/2002 | Morishita | 187/292 |
| 2003/0192745 | A1 | 10/2003 | Utsunomiya et al. | |
| 2004/0020725 | A1 * | 2/2004 | Utsunomiya et al. | 187/292 |

FOREIGN PATENT DOCUMENTS

| | | |
|---|---|---|
| DE | 10020787 | 1/2001 |
| EP | 0641 735 A1 | 3/1995 |
| EP | 0 673 873 A1 | 9/1995 |
| JP | 07291559 A | 11/1995 |
| JP | 11209032 A | 8/1999 |

* cited by examiner

*Primary Examiner*—Jonathan Salata
(74) *Attorney, Agent, or Firm*—Schweitzer Cornan Gross & Bondell LLP

(57) ABSTRACT

Equipment for reducing vibrations of a lift cage guided at rails comprises a plurality of guide elements for guiding the lift cage along the rails, a sensor for detecting positional changes of the lift cage and/or of accelerations occurring at the lift cage, an actuator arranged between the lift cage and the guide elements and a regulating device which, on the basis of the values transmitted by the sensor, controls the actuator for changing the position of the cage relative to the rails. The regulating device has an amplification which is variable in dependence on the vertical speed of the lift cage. The amplification of the regulating device is continuously raised after activation of the regulating device and continuously lowered after switching-off of the regulating device.

12 Claims, 3 Drawing Sheets

EQUIPMENT FOR VIBRATION DAMPING OF A LIFT CAGE

The present invention relates to equipment for reducing or damping vibrations of a lift cage guided at rails and to a corresponding method for vibration damping.

BACKGROUND OF THE INVENTION

During travel of a lift cage in a lift shaft, different forces can act on the cage, which consists of the cage body and a cage frame holding the cage body, and excite the system to vibrate. The causes of vibrations in that case can be, in particular, unevennesses in the guide rails and forces produced by the slipstream about the cage. Beyond that, lateral traction forces transmitted by the traction cables or sudden positional changes of the load during travel can produce transverse vibrations.

In order to increase travel comfort for persons using the lift, regulating systems are employed which are designed for the purpose of providing compensation for forces acting on the lift cage. For example, a system is known from U.S. Pat. No. 5,896,949 which comprises several guide elements connected to the lift cage and movable between two end settings. Vibrations or accelerations arising transversely to the direction of travel are measured by several sensors mounted at the cage and the signals thereof are used for control of a plurality of actuators arranged between the cage and the guide elements. The actuators are in that case controlled by a regulating device, which is connected with the sensors, in such a manner that they work in opposition to the arising vibrations and thereby suppress these as effectively as possible.

A typical characteristic of the method known from U.S. Pat. No. 5,896,949 as well as other methods for reducing vibrations of lift cages in accordance with the state of the art is that these operate with regulators which are linear and invariable with respect to time. The reason for that is that, in the design of the regulator, non-linear processes can be taken into consideration only with difficulty and accordingly for simplification of the concept of the regulator the starting point is that the disturbances which occur are linear. However, the consequence of such an assumption is that undesired vibrations can arise when the regulator is switched on at the beginning and end of travel of the lift. The cause of such vibrations is that non-linear changes in the state of the system are present and cannot be controlled by the linear and time-invariable behaviour of the regulator.

BRIEF DESCRIPTION OF THE INVENTION

The object of the present invention is accordingly to avoid vibrations or even shocks of the lift cage during starting up and stopping of the lift and during loading and unloading of the cage.

In accordance with the invention the amplification of the regulating device, which is responsible for suppression of vibration, is designed to be speed-variable and/or time-variable. Thus, according to a first aspect of the present invention, the amplification provided by the regulating device is dependent on the vertical speed of the lift cage, whereby better reaction to non-linear processes during starting up and during braking of the lift cage can be attained. According to a second aspect of the present invention the amplification may be continuously raised after switching-on of the regulating device, and continuously lowered after switching-off of the regulating device.

The measures in accordance with the invention allow adaptation of the behaviour of the regulating device, which is fundamentally designed to be linear and time-variable, to the above-mentioned non-linear processes. In particular, the vibrations that arise during starting up and stopping of the lift, during loading and unloading of the cage and during switching-on and switching-off of the regulating device, and even shocks attributed to an inappropriate reaction of a linear regulator to non-linear system changes, can be suppressed by measures which are comparatively simple to undertake.

According to a preferred embodiment of the present invention, the speed-variable or time-variable mode of behaviour of the regulating device may be realized through a time- or speed-dependent weighting of either the error signals or regulating deviations fed to the regulator, and/or of the setting signals which are produced by the regulator for the actuators. For this purpose several amplification blocks, through which the error signals or setting signals are weighted, can be provided within the regulating device. In such a case, part of the blocks can be responsible for realization of the speed-dependent behaviour of the regulating device, while so-called time delay blocks may be responsible for reaction to the switching-on and switching-off of the regulating device. This solution is distinguished by the fact that it is comparatively simple to realize. In particular, it is not necessary to modify the actual regulator converting the error signals supplied thereto into setting signals for the actuators. A linear and time-invariable regulator can thus be used as in the past.

According to a particularly preferred embodiment of the present invention, the regulating device may comprise two internal regulators, namely a position regulator and an acceleration regulator. The position regulator is responsible for so regulating the setting of the guide elements with respect to the guide rails that a sufficiently high damping travel is available at all times. This simply means that the lift cage or the frame holding the cage body shall follow the guide rails, particularly even with the corresponding unevennesses of the rails. The task of the acceleration regulator is to suppress the vibrations which arise at the cage frame and which can also be produced by the unevennesses. The target values of the forces which the two regulators of the actuators seek are then correspondingly summed and fed to the actuators as a common setting signal. This solution, which is already known from U.S. Pat. No. 5,896,949 makes it possible to pursue the two above-mentioned objectives, which in fact are mutually opposed, in an optimised manner.

When two separate regulators are employed it is preferable to initially linearly raise the amplification of the position regulator after switching-on of the regulating device, while the acceleration regulator is activated only with a certain time delay, but similarly with a linear rise. After switching-off of the regulating device, the amplification of the acceleration regulator is initially linearly reduced to zero and the position regulator is also switched off after a certain time delay.

BRIEF DESCRIPTION OF THE DRAWINGS

The invention is explained in more detail in the following on the basis of the accompanying drawings, in which.

DETAILED DESCRIPTION OF THE INVENTION

Before the regulating equipment according to the invention is explained in more detail, the realization of an overall system for active damping of vibrations or oscillations of a lift cage will initially be discussed with reference to FIG. 1.

Figure 1:
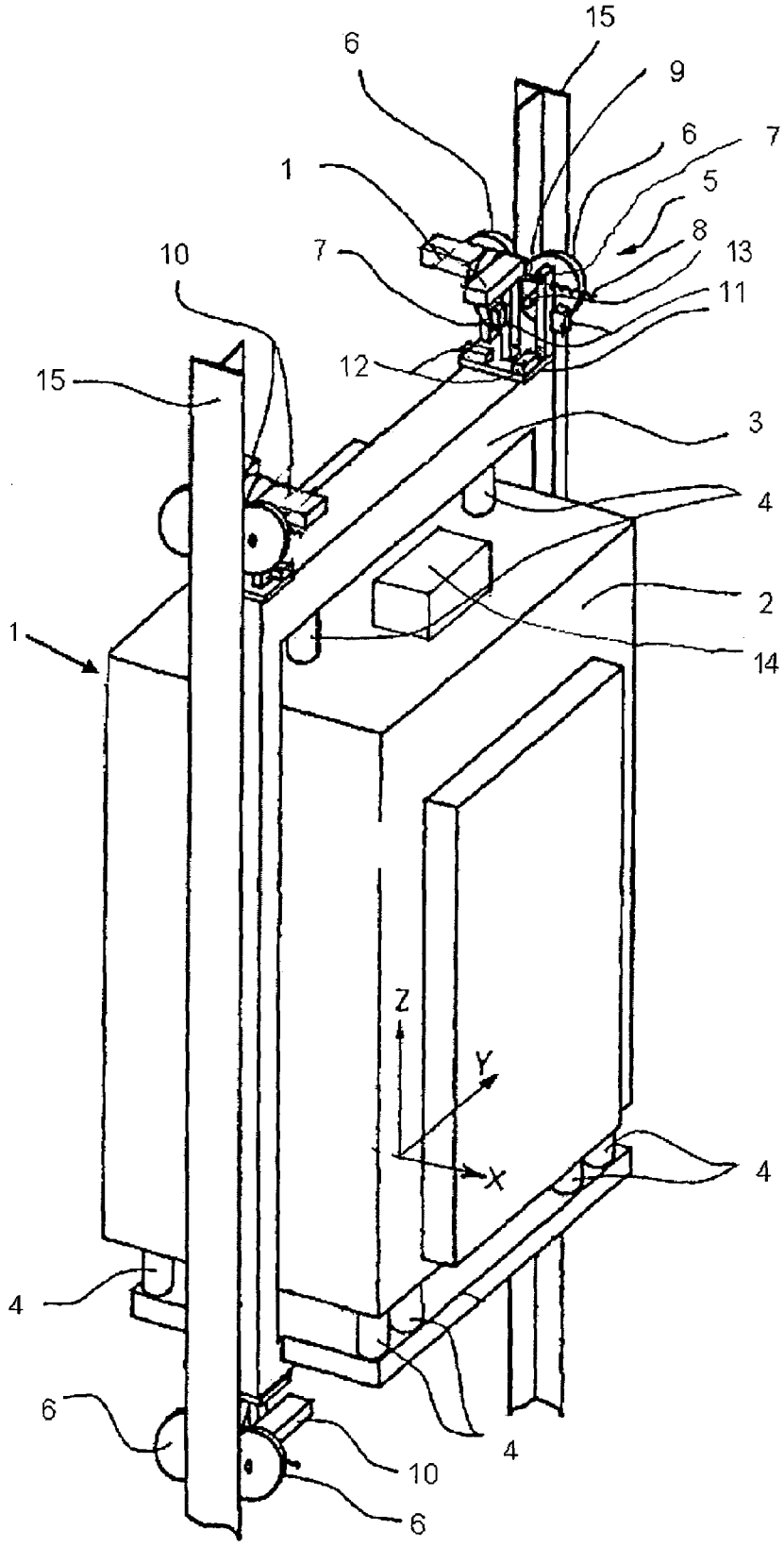
FIG. 1 is a schematic illustration of a lift cage guided at rails with which the invention is used.

The cage illustrated in FIG. 1 and provided generally with the reference numeral 1 is divided into a cage body 2 and a cage frame 3. The cage body 2 is mounted in the frame 3 with the help of several rubber springs 4 which are provided for insulation of solid-borne sound. These rubber springs 4 are designed to be comparatively stiff in order to suppress the occurrence of low-frequency vibrations.

The cage 1 is guided, with the help of four roller guides 5, at the two guide rails 15 which are arranged in a lift shaft (not shown). The four roller guides 5 are usually of identical construction and are mounted laterally at the bottom and the top at the cage frame 3. They each have a respective post on which are mounted three guide rollers 6, i.e. two lateral rollers and one center roller. The guide rollers 6 are each movably mounted with the help of a respective lever 7 and are pressed by way of a spring 8 against a guide rail 15. The levers 7 of the two lateral guide rollers 6 are, in addition, connected together by way of a tie rod 9 so that they move synchronously with one another.

Two electrical actuators 10, which exert on the respective levers 7 a force acting parallel to the associated springs 8, are provided for each roller guide 5. A first actuator 10 moves the center lever 7 together with the associated center guide roller 6, while the second actuator 10 moves the two lateral levers 7 together with the associated lateral guide rollers 6. The setting of the levers 7 and the rollers 6 and thereby the position of the lift cage 1 with respect to the guide rails 15 is thus controlled by the actuators 10.

The cage oscillations or vibrations to be damped by the equipment according to the present invention arise in the following five degrees of freedom:

displacements in the X direction
displacements in the Y direction
rotations about the X axis
rotations about the Y axis
rotations about the Z axis The different displacements or rotations in the five degrees of freedom are respectively attributable to a different mounting of the lift cage 1 at the four roller guides 5 in the X and/or the Y direction.

In order to be able to detect vibrations of the cage 1 in all five degrees of freedom, there are provided two position sensors 11 per roller guide 5, i.e. a first sensor for detecting the position of the center lever 7 together with the associated guide roller 6, and a second sensor for detecting the position of the two lateral levers 7 together with the associated lateral guide rollers 6. In addition, each roller guide 5 is equipped with two horizontally oriented acceleration sensors 12, of which one detects accelerations in the displacement direction of the center guide roller 6 and the second detects accelerations perpendicularly thereto in the displacement direction of the two lateral guide rollers 6. The measurement signals of the sensors 11 and 12 give information about the current position of the lift cage 1 in relation to the two guide rails 15 and additionally inform whether the cage body 1 is currently subject to accelerations which can lead to vibrations.

A control apparatus 14 fastened to the roof of the cage body 2 processes the signals transmitted by the sensors 11 and 12 and controls, after evaluation of the sensor signals, the electrical actuators 10 of the four roller guides 5 with the help of a power supply unit in order to counteract the accelerations and vibrations in an appropriate manner.

Figure 1A:
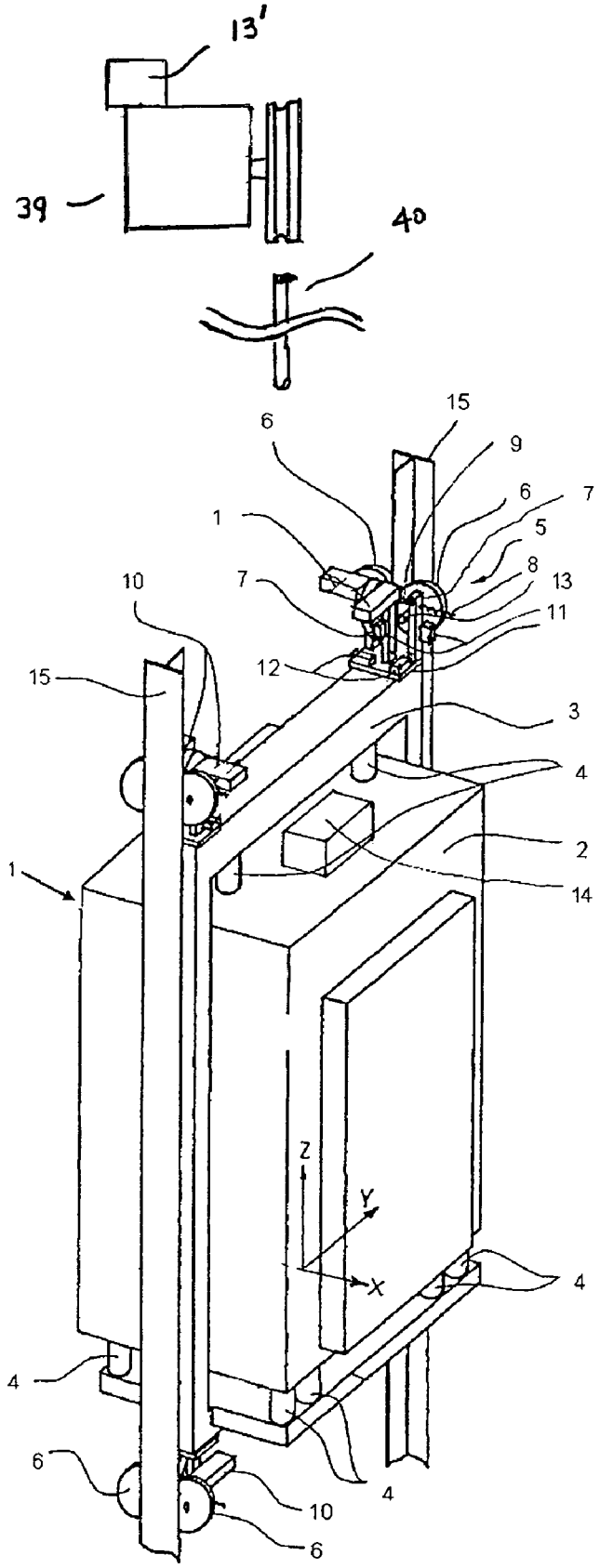
FIG. 1*a* is the schematic illustration of a lift cage of FIG. 1 in reduced scale, also depicting a drive lift and a cage support cable.

Before the design of the control apparatus 14, and in particular the regulating device arranged therein is explained in more detail it is to be pointed out that in the case of the lift cage illustrated in FIG. 1 a rotational movement sensor 13, which measures the rotational angle of a guide roller 6 associated therewith, is provided at a roller guide 5 (here at the righthand upper roller guide). The measurement values obtained by way of this rotational movement sensor 13 provide information about the travel path of the cage and about the current travel speed thereof in the vertical (Z) direction. The speed-variable regulation according to the present invention as described in the following is thereby made possible. Alternatively, as depicted in FIG. 1*a*, sensor 13' may be located remote from the cage on lift drive 39 and its output delivered to the control apparatus through, for example, a cage suspension cable 40, as depicted.

Figure 2:
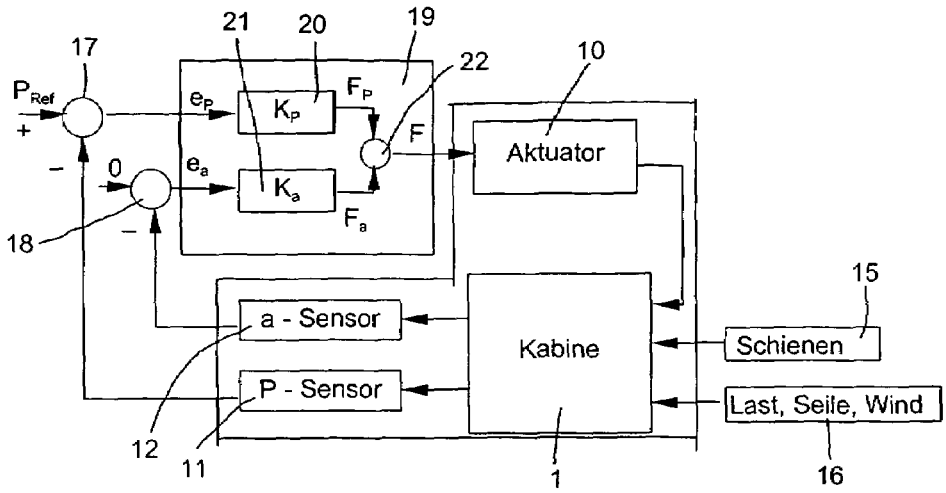
FIG. 2 is a signal flow diagram of a system for active vibration damping of the type with which the invention may be employed.
Figure 3:
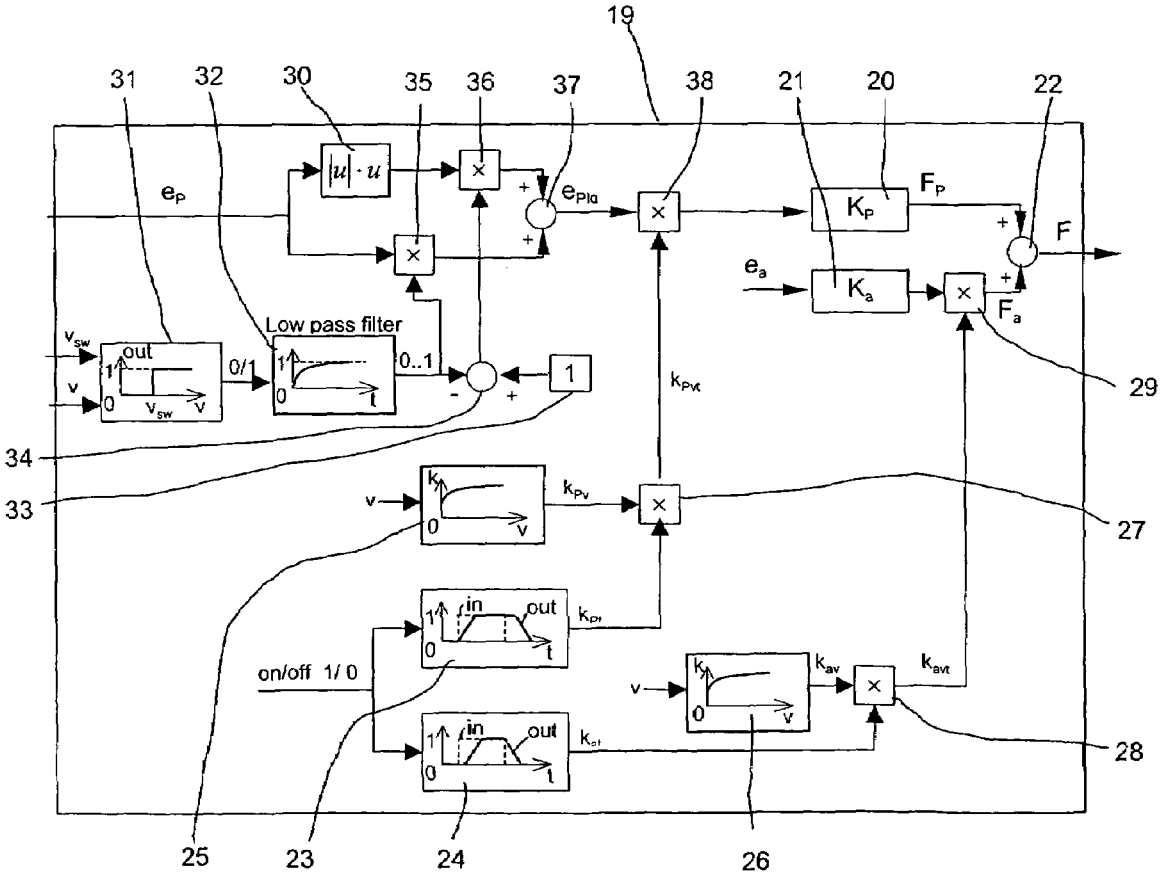
FIG. 3 is a signal flow diagram of the regulating equipment designed in accordance with the invention.

FIGS. 2 and 3 are signal flow diagrams of the system according to the invention for active vibration damping. The basic build-up according to FIG. 2 substantially corresponds with the method as also used in U.S. Pat. No. 5,896,949. The illustrated signals are to be understood as being vector signals comprising several signals of like kind. The regulating equipment is designed as a so-termed MIMO (Multi-Input Multi-Output) regulator which, on the basis of a plurality of input signals, determines a plurality of setting signals for the actuators disposed at the roller guides.

In the system illustrated in FIG. 1, external disturbances act on the cage 1, which are composed of indirect disturbing forces from the rails 15 as well as disturbing forces 16 which engage directly at the cage 1 in the form of cage load, cable forces and wind forces. The current state of the cage is ascertained with the assistance of the position sensors 11 and acceleration sensors 12, wherein initially the positions measured by the position sensors 11 are compared in a summation block 17 to reference values which reproduce a reference setting of the cage 1 with respect to the rails 15. The result of the comparison/summation is an error signal or regulating deviation $e_p$, which describes the deviations of the positions of the roller guides with respect to the reference settings. In the summation block 18, the acceleration values of the acceleration sensors 12 are negated, i.e. subtracted from the ideal or reference value 0 (no accelerations), whereby a second error signal ea is produced.

The regulating equipment 19 is composed, as already mentioned, of two regulators, i.e. a position regulator ($K_p$) 20 as well as an acceleration regulator ($K_a$) 21. The reason for use of two separate regulators is that an objective of the regulating equipment 19 is to suppress cage vibrations in the high-frequency range (between 0.9 and 15 Hz, and preferably between 0.9 and 5 Hz) without the regulated lift having a worse behaviour outside this frequency range than an unregulated lift. On the other hand, the regulating equipment 19 has to ensure that the setting of the cage frame 3 with respect to the guide rails 15 is so regulated that a sufficient damping travel at the rails is available at any time. This is particularly important when the cage 1 is asymmetrically loaded.

For the first regulating purpose an acceleration or speed feedback with inertia sensors is sufficient, while for the second regulating objective position feedback is required. The two feedbacks have two opposing objectives, which are pursued by the use of the two separate regulators 20 and 21. As illustrated in FIG. 2, the position regulator 20 takes into consideration exclusively the measurement values of the position sensors 11 and is correspondingly responsible for maintenance of the guidance play of the cage 1. The acceleration regulator 21, processes the measurement values of the acceleration sensors 12 and is required for suppression of vibrations. The target or setting values of the two regulators 20 and 21 are summed in the summation block 23 and fed as a common setting signal to the actuators 10.

The solution for avoidance of the above-mentioned conflict between the two regulators 20 and 21 is based on the circumstance that the forces responsible for a skewed position of the cage 1 (a non-symmetrical loading of the cage, a large lateral cable force and the like) change substantially more slowly than the other sources of disturbance causing cage vibrations. These other sources are principally rail unevennesses or air disturbance forces. The amplification changes in the frequency range are always continuous, i.e. there are no fixed limits. At a defined frequency, the two regulators 20 and 21 have much the same influence. Above that frequency the acceleration regulator 21. acts more strongly and below that frequency that the position regulator 20 acts more strongly.

The two above-mentioned regulating objectives can be pursued through division of the regulating equipment 19 into a position regulating circuit and an acceleration regulating circuit. A further advantage of the division is that the regulators 20 and 21 do not contain non-linearities. An analysis of stability and thus a corresponding configuring of the two regulators would otherwise be possible only with difficulty.

The design of the position regulator 20 and acceleration regulator 21 as linear regulators has, however, the consequence that they cannot react in a suitable manner to non-linear processes which arise, for example, during starting up and during braking of the lift cage, or during switching-on and switching-off of the regulating device. In order to be able to take these processes into consideration, the behaviour of the two regulators 20 and 21 is designed in accordance with the present invention to be time-variable and speed-variable, which is explained in the following by reference to FIG. 3.

FIG. 3 presents the extended signal flow diagram of the method according to the invention, wherein only the extended regulator device 19 is shown, since the other parts of the system—cage, actuators and sensors—remain unchanged.

The time-variable and speed-variable design of the regulating device in accordance with the invention is achieved in that the error signals $e_p$, which are developed by the summation point 17 and provided to the position regulator 20 are initially weighted or multiplied by specific factors before they are fed to the position regulator 20. The variable behaviour of the acceleration regulating loop is realized in that the setting signals developed by the acceleration regulator 21 on the basis of the error signals $e_a$ fed thereto are weighted by several amplification factors. In both cases the amplification of the regulator 20 or 21 is varied with respect to the instant in time and the vertical speed of the cage.

The time-variable behaviour of the two regulators 20 and 21 is produced by two so-called time delay blocks 23 and 24, which are controlled by a common signal with the value 1 or 0. After initial switching-on of the regulating device the amplification factor $k_{pt}$ for the position regulator 20 is continuously raised and, in particular, with a linear rise from 0 to 1. The amplification factor $k_{at}$ for the acceleration regulator 21 similarly follows, with a certain delay in time, with a linear rise from 0 to 1. After switching-off of the regulating device, the amplification $k_{at}$ for the acceleration regulator 21 is linearly reduced from 1 to 0, while the amplification factor $k_{pt}$ for the position regulator 20 is lowered in a time-delayed manner. The staggered placing in operation and deactivation of the two regulators 20, 21 achieved in this manner permits a particularly good reaction to the processes during switching-on and switching-off of the regulating device.

The amplification factors $k_{Pt}$ and $k_{at}$ delivered by the time delay blocks 23 and 24 are, in addition, also respectively multiplied in the blocks 27 and 28 by a corresponding speed-dependent factor $k_{Pv}$ and $k_{av}$ so that the amplification factors $k_{Pvt}$ for the position regulator 20 and $k_{avt}$ for the acceleration regulator 21 result. The speed factors $k_{Pv}$ and $k_{av}$ are respectively produced by two blocks 25 and 26 which determine the two weighting factors in dependence on the speed value v, determined by the rotational speed sensor 13. The speed-dependent amplification values may be filed in tables and linearly intabulated. It is important that the two amplification factors $k_{Pv}$ and $k_{av}$ which are dependent on the absolute amount of the speed v are themselves never zero, whereby it is ensured that regulation still takes place even when the cage is at standstill.

The amplification factor $k_{avt}$, for the acceleration regulator 21 is then multiplied in block 29 by the output signal or setting signal of the acceleration sensor 21. The amplification factor $k_{Pvt}$ for the position regulator 21 is similarly multiplied in the multiplication block 28 by a modified error signal $e_{pla}$ and fed to the position regulator 20.

The error signal $e_p$ delivered by the summation block 17 is itself still subject to a modification which takes into account that in the case of relatively large deviations in position, as can happen at standstill of the cage (for example during loading), a quick correction has to be available. In order to take this circumstance into account, the square of the position error $e_p$ with the same sign is formed in block 30 so that, on the one hand, a position error $e_p$ is present in linear form and, on the other hand, is also present in squared form. In the case of relatively large deviations, the squared error signal is to be used in order to achieve a sufficiently rapid correction of position. During travel of the cage, however, the large amplification would lead to vibrations and even to instabilities, for which reason it is necessary to switch over from the squared position error to the linear position error in dependence on travel speed.

The switching over itself should not, however, be carried out abruptly, so as not to produce any further instabilities. The consequently desired continuous transition is achieved with the help of an error signal modification device formed by blocks 30 to 37, wherein block 31 initially switches an output signal from 0 to 1 when the (directionally independent) travel speed v exceeds a threshold value $v_{sw}$. Block 32 is a low-pass filter and causes a time-delayed continuous change in its output signal in the case of abrupt change of the input signal received by block 31, i.e. when the threshold value is exceeded. The output of the low-pass filter is multiplied in block 35 by the linear position error, while the difference between the reference value 1 and the output value delivered by the low-pass filter 32 is produced in the summation block 34 and is multiplied in block 36 by the squared position error. The sum of the amplification values fed to the multiplication block 35 for the linear error on the one hand and to the multiplication block 36 for the squared error on the other hand is thus always 1, as the component of the squared error continuously decreases after the limit speed $v_{sw}$ is exceeded, the component of the linear error increases. The linear and squared position errors weighted in this manner are superimposed in summation block 37 and finally multiplied in the block 38 by the time-dependent and speed-dependent amplification factor $k_{Pvt}$. The values weighted in this manner are ultimately fed to the position regulator 20 as input signals.

The weighting and amplification of the position and acceleration regulating loops realized in this manner enable adaptation of the behaviour of the regulating device to non-linear processes which arise during switching-on and switching-off of the regulator and during starting-up and braking of the lift cage. A decisive advantage of the solution according to the invention is that the position and acceleration regulators can be designed, as before, to be linear and time-invariable and thus the overall cost for configuring the regulating device is increased only slightly. The taking into account of the time-dependent and speed-dependent factors can be carried out without greater cost, so that the entire regulating behaviour of the equipment according to the invention can be significantly improved in a simple manner. The switching over between the linear and the square error signal for the position of the guide elements additionally makes it possible to achieve, at standstill of the lift cage, the quickest possible regulation with respect to changes in position.

We claim:

1. Equipment for reducing vibrations of a lift cage guided at rails, comprising:

a plurality of guide elements for guiding the lift cage along the rails;

a sensor for detecting positional changes of the lift cage and/or accelerations occurring at the lift cage;

an actuator arranged between the lift cage and the guide elements; and a regulating device for controlling the actuator on the basis of values transmitted from the sensor for changing the position of the cage relative to the rails, the regulating device having a amplification variable in dependence on a vertical speed of the lift cage.

2. The equipment according to claim 1, characterized in that the regulating device comprises a time delay device which continuously raises the amplification of the regulating device upon receipt of an activation signal for the regulating device and continuously lowers the amplification after receipt of a deactivation signal for the regulating device.

3. The equipment according to claim 1 or 2, further comprising a speed sensor which detects cage vertical speed, the regulating device having means for converting a measurement value produced by the speed sensor into a speed-dependent amplification factor and for multiplying the amplification factor by at least one of an input signal for a regulator and a setting signal for input to the regulator for controlling the actuator.

4. The equipment according to claim 3, wherein the speed sensor is located at a lift drive, the measurement value being transferred to the regulating device by way of a suspension cable.

5. The equipment according to claim 1 or 2 characterized in that the regulating device comprises an error signal modification device for modifying an error signal ascertained by position sensors arranged at the lift cage and feeding the modified error signal to a position regulator in a squared form below a predetermined limit speed of the cage and in a linear form above the limit speed.

6. The equipment according to claim 5, characterized in that a corresponding change between the squared and linear forms is carried out whenever the limit speed is traversed.

7. The equipment according to claim 1 or 2 characterized in that the regulating device comprises a time delay device for raising the amplification of the regulating device after activation of the regulating device and for lowering the amplification of the regulating device after deactivation of the regulating device.

8. The equipment according to claim 1 or 2 characterized in that the regulating equipment comprises:

a position regulator for controlling the actuator in dependence on signals from position sensors arranged at the lift cage whereby the guide elements adopt a predetermined position;

an acceleration regulator for controlling the actuator in dependence on signals from acceleration sensors arranged at the lift cage whereby vibrations arising at the lift cage are suppressed; and means for summing setting signals from the position regulator and the acceleration regulator and feeding a summed signal to the actuator.

9. The equipment according to claim 8 wherein the time delay device is a time delay block associated with the position regulator for forming an amplification factor that linearly rises after activation of the regulating device and linearly drops to 0 after deactivation of the regulating device.

10. The equipment according to claim 9, characterised in that the drop of the amplification factor is carried out delayed in time after deactivation of the regulating device.

11. The equipment according to claim 9 or 10, further comprising a second delay block for forming an amplification factor for the acceleration regulator that linearly rises in a time-delayed manner after activation of the regulating device and linearly drops to 0 after deactivation of the regulating device.

12. The equipment according to claim 11 characterized in that the rise of the amplification factor for the acceleration regulator occurs in a time-delayed manner after commencement of rise of the amplification factor for the position regulator.

* * * * *